US005622334A

United States Patent [19]

Welter et al.

[11] Patent Number: 5,622,334

[45] Date of Patent: Apr. 22, 1997

[54] DISPENSER FOR ROLLED MATERIAL

[76] Inventors: Brian T. Welter, 235 Lamont Pkwy., Bartlett, Ill. 60103; Curtis M. Ginter, 625 N. Walnut La., Schaumburg, Ill. 60194

[21] Appl. No.: 526,202

[22] Filed: Sep. 11, 1995

[51] Int. Cl.[6] ..... B65H 19/00

[52] U.S. Cl. ..... 242/598.2

[58] Field of Search ..... 242/598, 598.2, 242/598.5, 599, 599.3

[56] References Cited

U.S. PATENT DOCUMENTS

| | | | |
|---|---|---|---|
| 2,517,809 | 8/1950 | Tarzian | 242/598.2 |
| 3,022,957 | 2/1962 | Blunt et al. | 242/598.2 |
| 3,438,589 | 4/1969 | Jespersen | 242/594.3 |
| 3,823,889 | 7/1974 | Johnson et al. . | |
| 4,105,168 | 8/1978 | Rutherford . | |
| 4,326,678 | 4/1982 | Hamm . | |
| 4,432,504 | 2/1984 | Pace . | |
| 4,634,067 | 1/1987 | White . | |
| 4,824,038 | 4/1989 | Chandler | 242/598.2 |
| 5,149,003 | 9/1992 | Tharp . | |
| 5,222,678 | 6/1993 | Carrington . | |
| 5,253,818 | 10/1993 | Craddock . | |

*Primary Examiner*—John P. Darling

[57] ABSTRACT

A material roll holder and dispenser comprising two side arms and a roll-holding rod. The roll-holding rod is attached to one side arm by means of a dowel about which it pivots freely. The other side arm is used to secure the opposite end of the roll-holding rod.

1 Claim, 7 Drawing Sheets

DISPENSER FOR ROLLED MATERIAL

BACKGROUND OF INVENTION

1. Field of the Invention

The present invention is a device for holding and dispensing rolled material with a hollow tube center. More specifically, it is comprised of a wall plate, two side arms and a roll-holding arm. The roll-holding arm is hinged on one of the side arms, which enables it to pivot for the purpose of loading and unloading rolled material, and is able to be secured on the other side arm so that a roll of material may spin freely and securely upon the roll holding arm.

2. Prior Art

Devices for holding rolled material are well known. Numerous patents have been issued attempting to simplify the installation of a new roll of material and removal of the spent roll. The most widely used twice utilizes a wall plate, two side arms and a compressible spring loaded robe. The wall plate is used to secure the assembly to a wall or other mounting surface, the two side arms are used to support the spring loaded robe and the robe is inserted between the two side arms to support the rolled material. Although this typo is the most common it is not the easiest to use. In fact, it can even sometimes be frustrating for children and the elderly.

The following U.S. patents have attempted to simplify the roll changing process:

| | | |
|---|---|---|
| 3,823,889 | 4,326,678 | 5,222,678 |
| 4,105,168 | 4,634,067 | 5,253,818 |
| 4,432,504 | 5,149,003 | |

These patents are either too costly and complex to manufacture or have not overcome the obstacle of simplifying the roll changing process. The present invention is an improved design from the above mentioned patents through its simple design, ease of manufacture and ease of operation.

The features and advantages of the present invention will become apparent from the following detailed description of the invention when read with the accompanying drawings.

SUMMARY OF THE INVENTION

This invention improves upon other prior art devices which attempted to simplify the roll changing process. This is accomplished by a hinged roll-holding arm, secured between two side arms, which is pivotal on one side and securable on the other.

DETAILED DESCRIPTION

Figure 1:
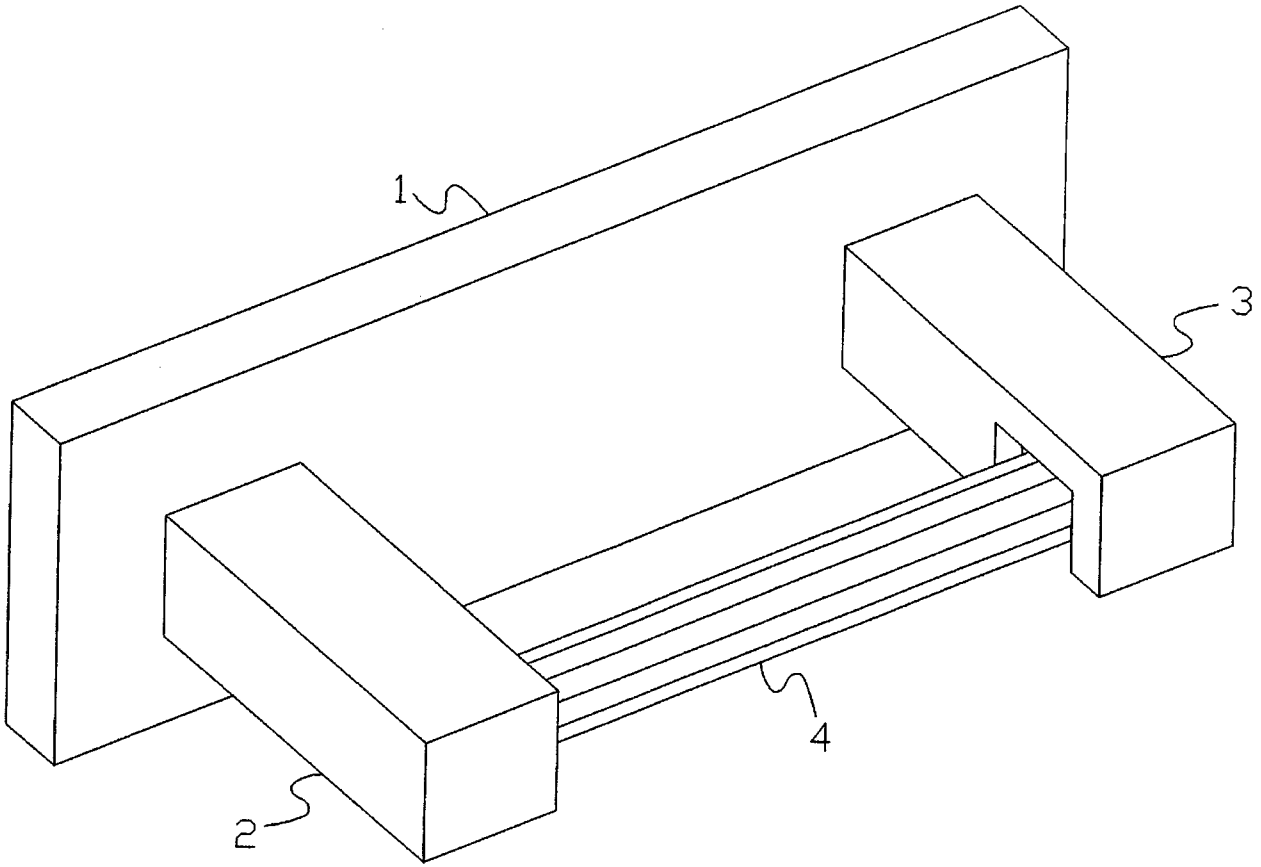
FIG. 1 is downward perspective view of the present invention.
Figure 2:
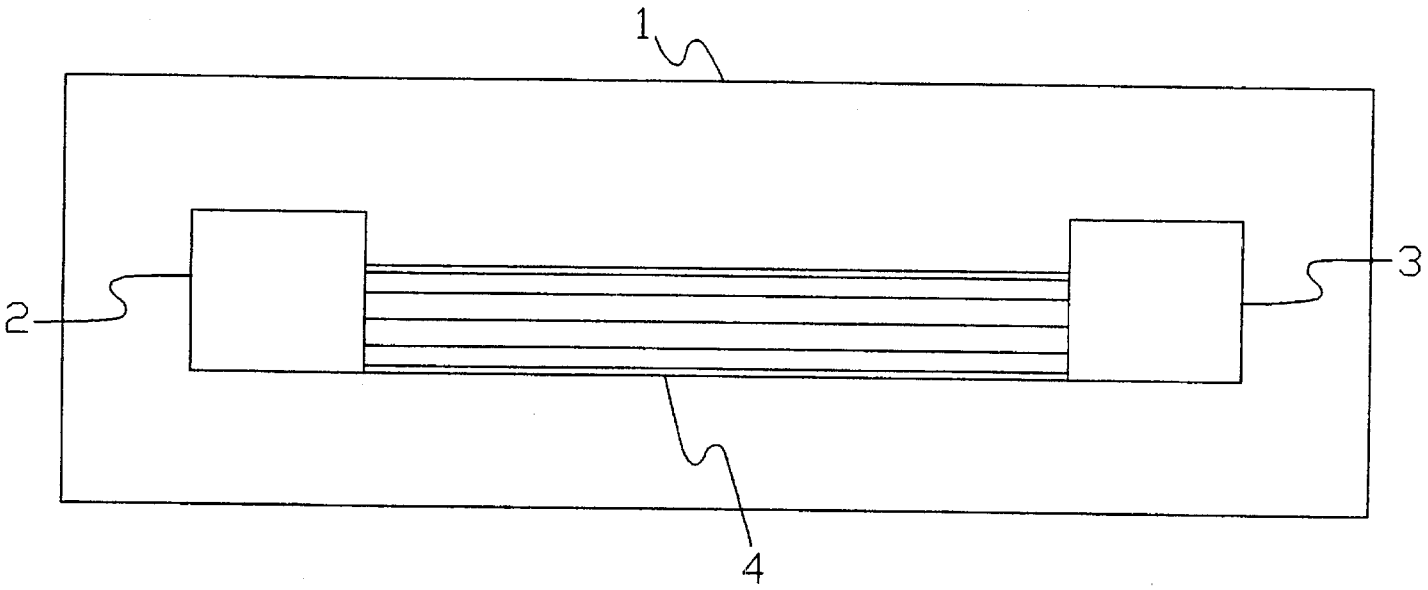
FIG. 2 is a front view of the present invention.
Figure 3:
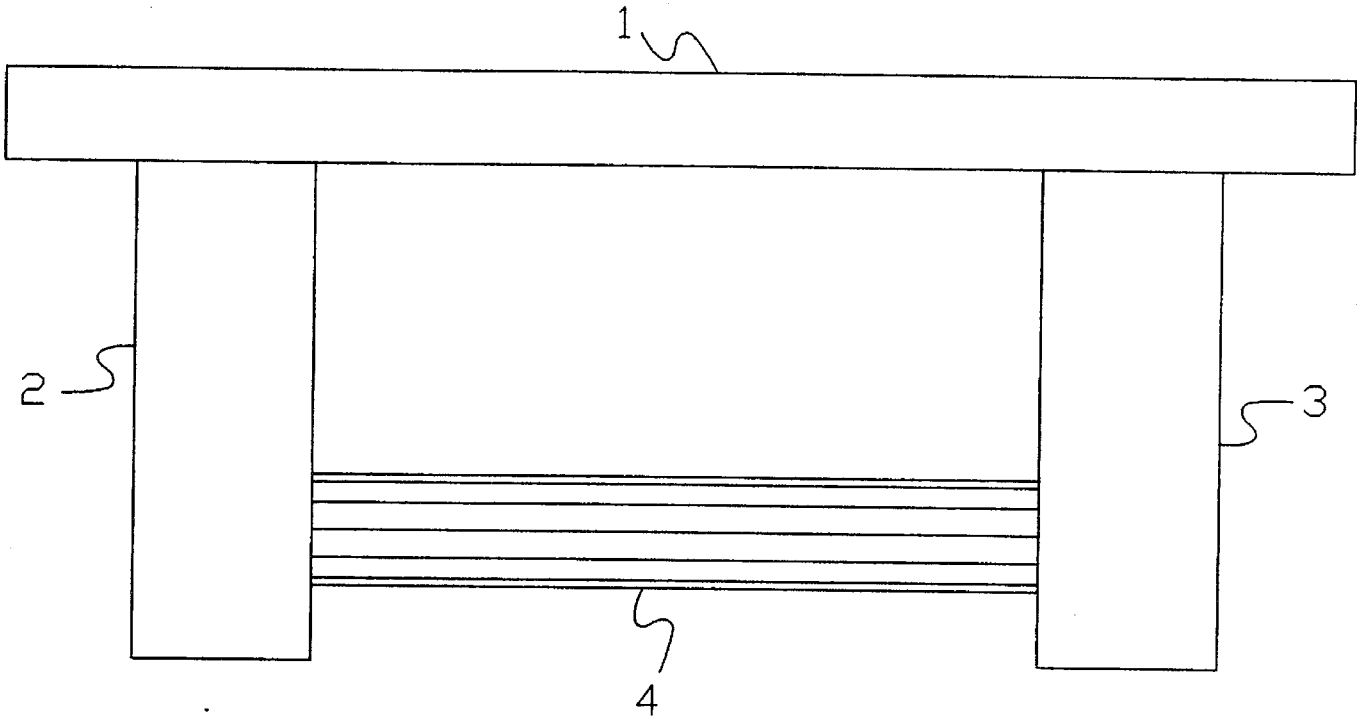
FIG. 3 is a top view of the present invention.

Referring now to the drawings, there is shown the preferred embodiment for the dispenser for rolled material which provides a holder for holding and dispensing toilet tissue.

Referring now to the drawings, more specifically FIG. 1. The dispenser for rolled material consists of a rectangular base (1) which is used for attachment of the device as a whole to a wall or other surface. Extending outwardly from the front of the base are two side arms (2 & 3).

Figure 5:
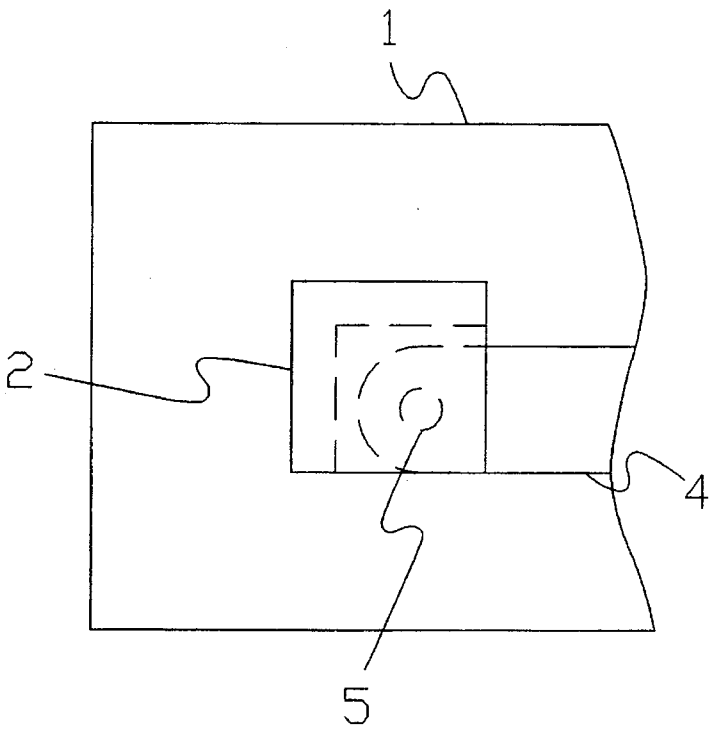
FIG. 5 is a front elevation view of the side arm containing the dowel rod.
Figure 4:
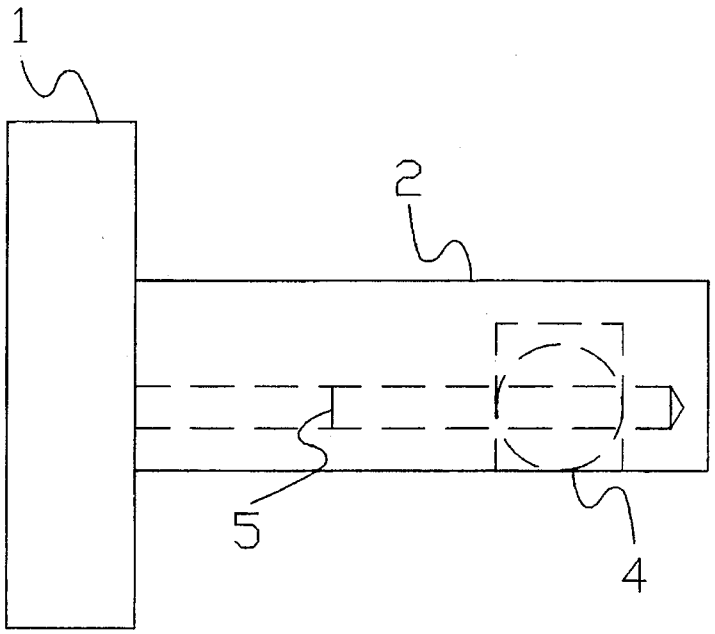
FIG. 4 is a side elevation view of the side arm containing the dowel rod.

Referring now to FIG. 4 and FIG. 5. This side arm (2) has a partial channel cut into it with its opening facing down and toward the opposite side arm (3). A dowel hole is drilled longitudinally through the back of the side arm (2) passing through the channel, but not passing through the front. The roll-holding arm (4) is a cylindrical rod with one spherical end and one flat end. The spherical end has a dowel hole drilled through the center of the sphere and is positioned perpendicularly to the longitudinal axis of the roll-holding arm. The roll-holding arm is secured on one end to the side arm (2) by means of a dowel rod (5) which is placed through the dowel hole of the side arm (2) and the dowel hole of the roll-holding arm (4). This enables the roll holding arm to pivot parallel to the base.

Figure 7:
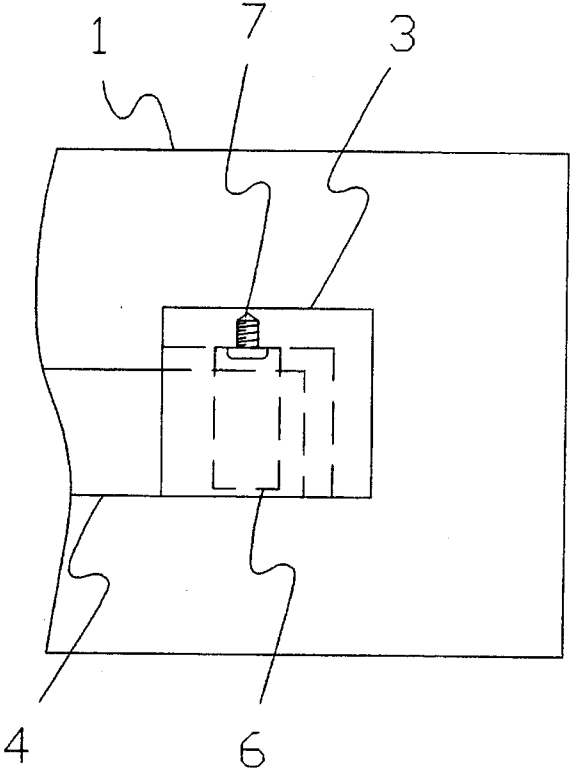
FIG. 7 is a front elevation view of the side arm containing the securing device.
Figure 6:
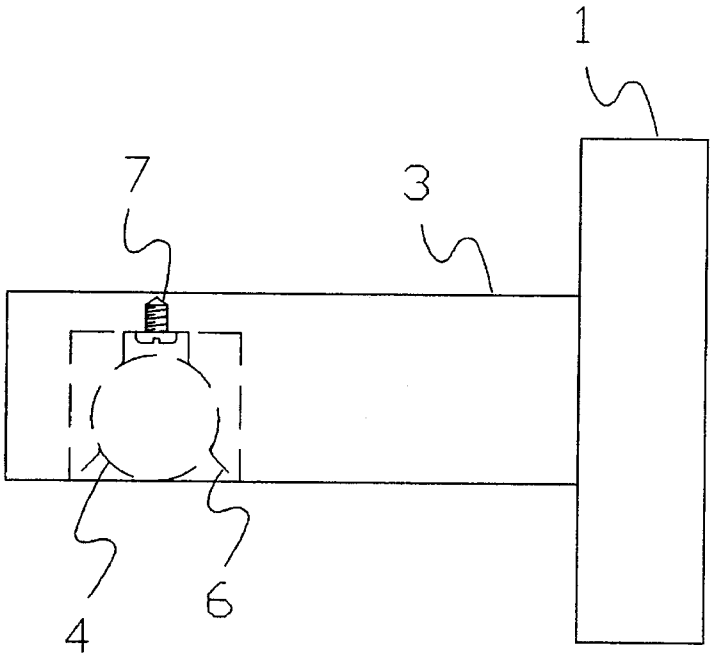
FIG. 6 is a side elevation view of the side arm containing the securing device.
Figure 8:
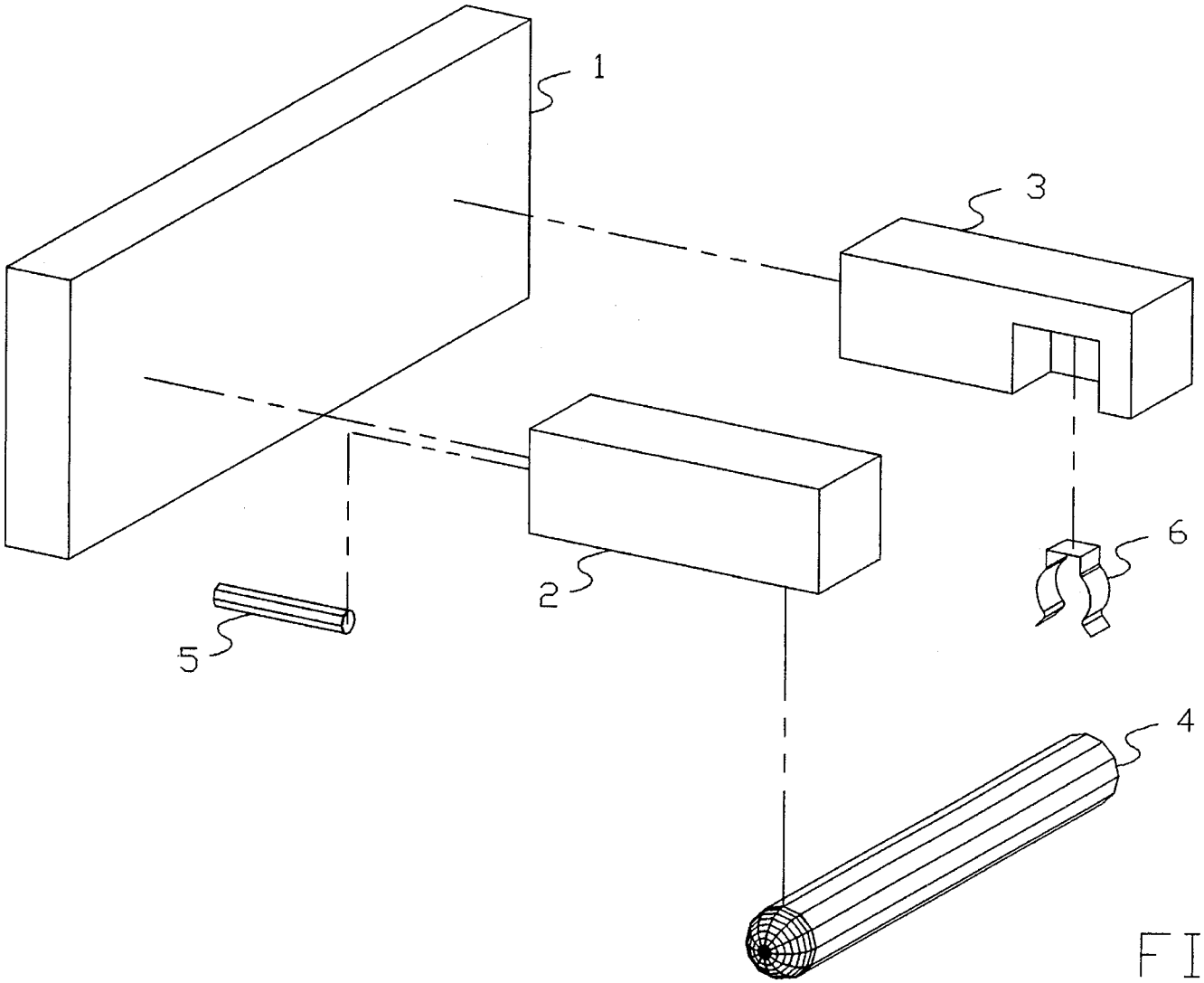
FIG. 8 is an exploded view of the present invention.
Figure 9:
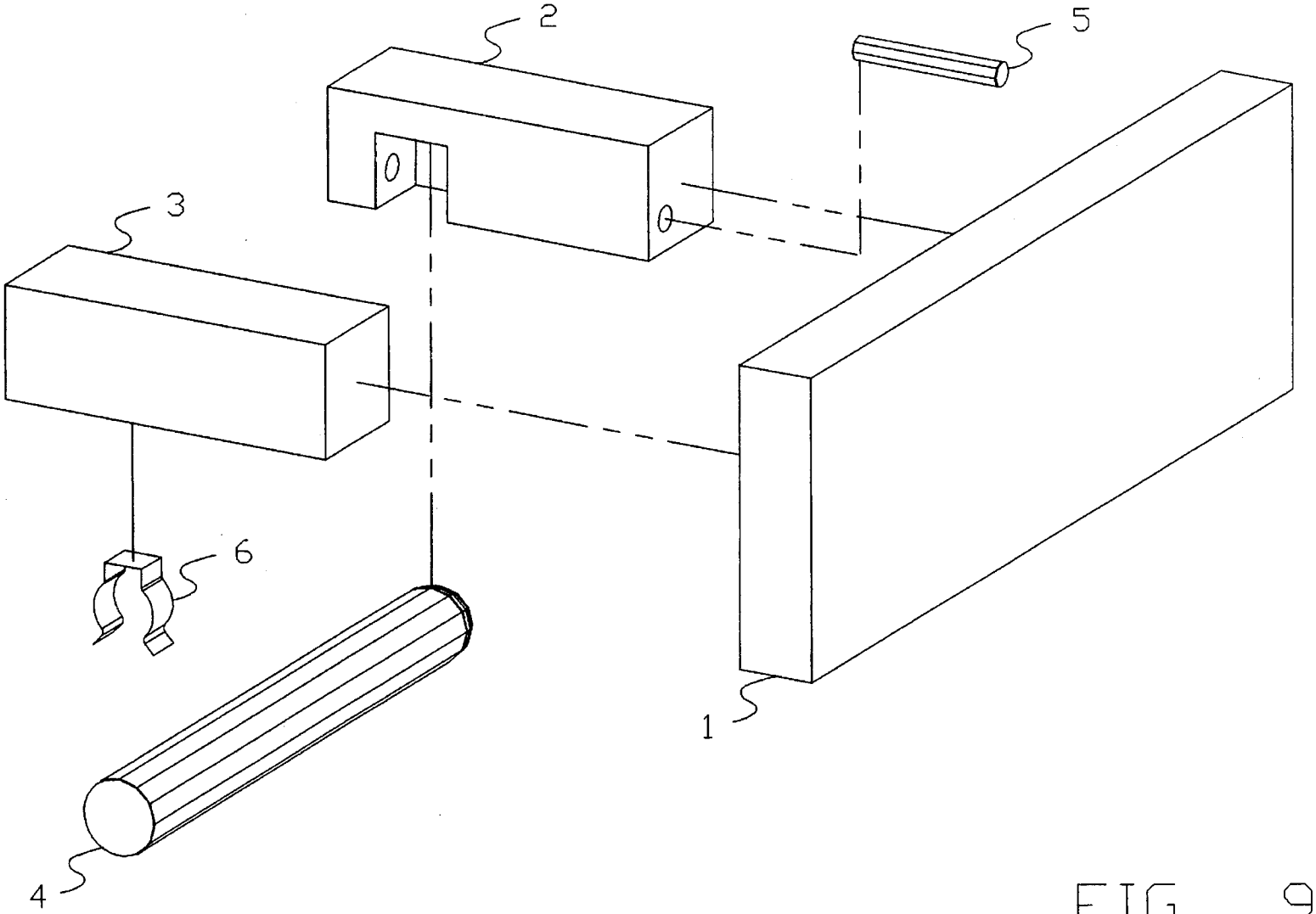
FIG. 9 is an exploded view of the present invention.

Referring now to FIG. 6 and FIG. 7. This side arm (3) has a partial channel cut into it with its opening facing down and toward the opposite side arm (2). A clip (6) is used to secure the roll-holding arm and is attached to the top plane of the partial channel in the side arm (3) by means of a metal screw (7).

From the secured horizontal position, the roll-holding arm may travel to an unsecured position. In the unsecured position sufficient space exists to place a material roll on to the roll-holding arm.

The intended use of the device should be apparent from the onset. The roll-holding arm can be unsnapped from a tension clip such that it can pivot freely about a dowel rod fastened in one of the side arms. The roll-holding arm can pivot to a position such that a roll of material may be placed over the arm. When the roll is in place, the arm may be pivoted towards the metal tension clip such that the arm snaps into the clip and is thereby held secure. When the roll-holding arm is secured the arm supports the rolled material in such a manner that the roll can spin unobstructed on the arm.

It will be understood by those skilled in the art that the present embodiment of the invention is a preferred embodiment, but by no means is it meant to be restrictive. Modifications may be made without departing from the appended claim.

We claim:

1. A dispenser for rolled sheet material having a hollow center, said dispenser comprising:

a base having first and second opposed ends;

a first side arm extending generally perpendicularly from said base and mounted at said first opposed end of said base, a second side arm extending generally perpendicularly from said base and mounted at said second opposed end of said base;

a roll holding arm having first and second opposed ends supported by and extending between said side arms and generally parallel to said base;

first means for securing said first end of said roll holding arm, said first means secured in said first side arm generally perpendicular to said base and extending through said first end of said roll holding arm to allow said roll holding arm to pivot in a plane parallel to said base;

second means for releasably securing said second end of said roll holding arm, said second means secured in said second side arm.

* * * * *